US006591618B1

(12) United States Patent
Howard et al.

(10) Patent No.: US 6,591,618 B1
(45) Date of Patent: Jul. 15, 2003

(54) SUPERCRITICAL REFRIGERATION SYSTEM

(75) Inventors: Henry Edward Howard, Grand Island, NY (US); Arun Acharya, East Amherst, NY (US); Bayram Arman, Grand Island, NY (US); James Bragdon Wulf, Williamsville, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 10/216,359

(22) Filed: Aug. 12, 2002

(51) Int. Cl.[7] ..... F25B 1/00
(52) U.S. Cl. ..... 62/114
(58) Field of Search ..... 62/114, 118, 467, 62/498, 513; 252/67

(56) References Cited

U.S. PATENT DOCUMENTS

| | | | | |
|---|---|---|---|---|
| 3,237,403 A | | 3/1966 | Feher | 60/36 |
| 4,205,532 A | | 6/1980 | Brenan | 62/115 |
| 5,245,836 A | | 9/1993 | Lorentzen et al. | 62/174 |
| 5,497,631 A | | 3/1996 | Lorentzen et al. | 62/115 |
| 5,655,378 A | | 8/1997 | Pettersen | 62/174 |
| 5,916,260 A | * | 6/1999 | Dubar | 62/613 |
| 6,076,372 A | | 6/2000 | Acharya et al. | 62/606 |
| 6,105,388 A | | 8/2000 | Acharya et al. | 62/612 |
| 6,112,547 A | | 9/2000 | Spauschus et al. | 62/476 |
| 6,134,900 A | * | 10/2000 | Nishida et al. | 62/216 |
| 6,357,257 B1 | | 3/2002 | Goble, Jr. et al. | 62/613 |

* cited by examiner

*Primary Examiner*—Denise L. Esquivel
*Assistant Examiner*—Malik N. Drake
(74) *Attorney, Agent, or Firm*—Stanley Ktorides

(57) ABSTRACT

A method for providing refrigeration to a refrigeration load which enables the use of environmentally friendly refrigerants with lower power consumption than with conventional refrigerants wherein the low side pressure of the circuit exceeds the critical pressure of the refrigerant fluid and the refrigerant fluid is compressed to a higher supercritical pressure prior to expansion.

14 Claims, 1 Drawing Sheet

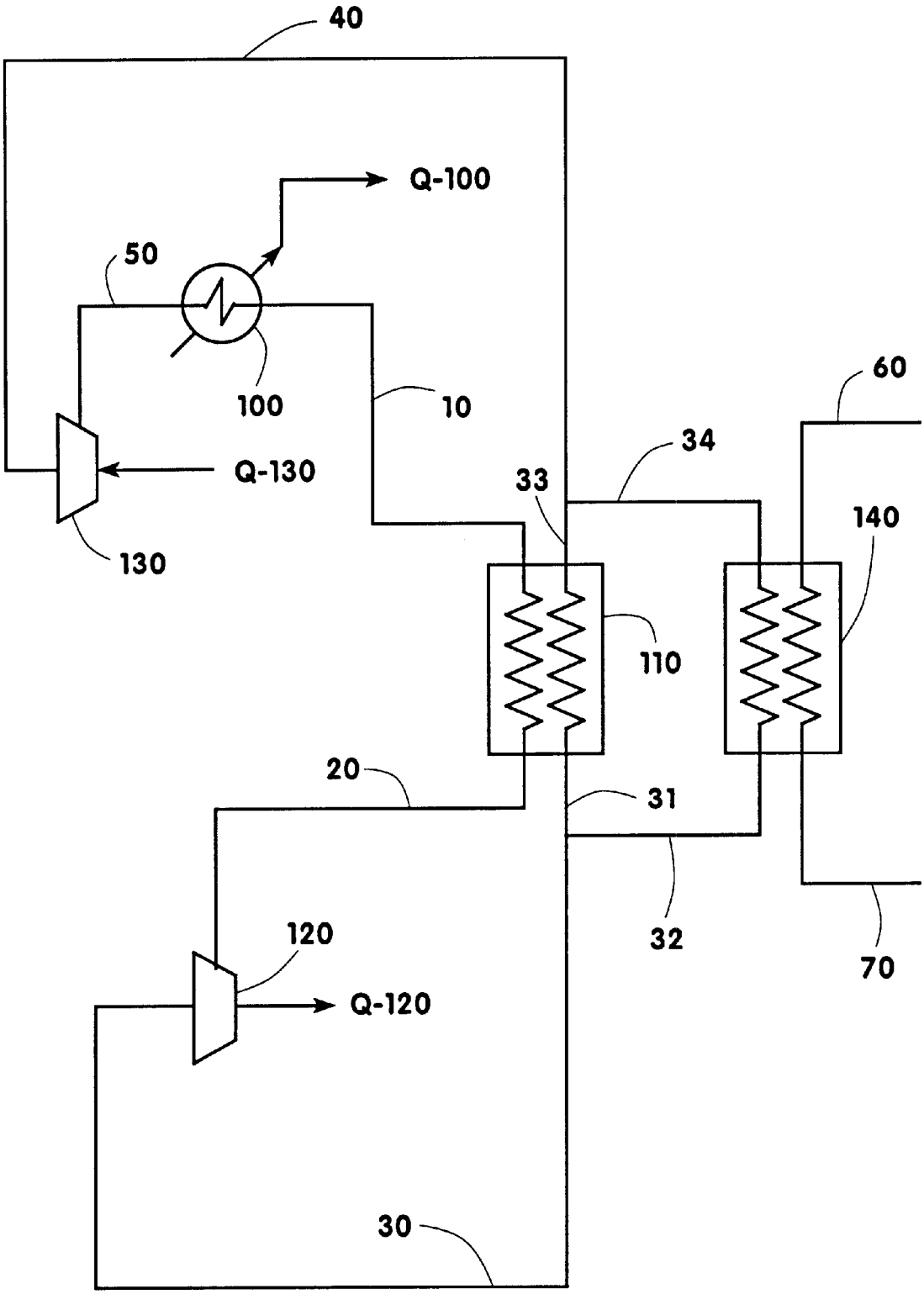
40
Q-100
50
100
10
60
34
Q-130
33
140
130
110
20
31
32
70
120
Q-120
30

SUPERCRITICAL REFRIGERATION SYSTEM

TECHNICAL FIELD

This invention relates generally to refrigeration and, more particularly, to the generation of refrigeration using refrigerant fluids which have a lesser environmental impact than do conventional refrigerant fluids.

BACKGROUND ART

Conventional refrigerants, such as chlorofluorocarbons, are being phased out because of their high environmental impact and are being replaced by other more environmentally friendly refrigerant fluids. However, in general, a refrigeration cycle or circuit using such replacement refrigerant fluids consumes significantly more power than one using conventional refrigerants on an equivalent refrigeration basis. This markedly reduces the advantages of using such replacement refrigerants.

Accordingly it is an object of this invention to provide a method for providing refrigeration which can more effectively employ environmentally friendly refrigerant fluids to generate the refrigeration.

SUMMARY OF THE INVENTION

The above and other objects, which will become apparent to those skilled in the art upon a reading of this disclosure, are attained by the present invention which is:

A method for providing refrigeration to a refrigeration load comprising:

(A) providing warm temperature supercritical pressure refrigerant fluid and compressing the warm temperature supercritical pressure refrigerant fluid to be at a higher supercritical pressure;

(B) cooling the higher supercritical pressure refrigerant fluid and expanding the cooled higher supercritical pressure refrigerant fluid to produce cold temperature supercritical pressure refrigerant fluid; and (C) warming the cold temperature supercritical pressure refrigerant fluid by indirect heat exchange with said cooling higher supercritical pressure refrigerant fluid and by indirect heat exchange with a refrigeration load to produce said warm temperature supercritical pressure refrigerant fluid.

As used herein the term "critical pressure" means the pressure of a fluid at which the liquid and vapor phases can no longer be differentiated. A supercritical pressure fluid is a fluid which is at a pressure which is greater than its critical pressure.

As used herein the term "critical temperature" means the temperature of a fluid above which a distinct liquid phase can no longer be formed regardless of pressure.

As used herein the term "expansion" means to effect a reduction in pressure.

As used herein the term "expansion device" means apparatus for effecting expansion of a fluid.

As used herein the term "compressor" means apparatus for effecting compression of a fluid.

As used herein the term "refrigeration" means the capability to reject heat from a subambient temperature system.

As used herein the term "refrigerant fluid" means a fluid in a refrigeration process which undergoes changes in temperature, pressure and possibly phase to absorb heat at a lower temperature and reject it at a higher temperature.

As used herein the term "indirect heat exchange" means the bringing of fluids into heat exchange relation without any physical contact or intermixing of the fluids with each other.

As used herein the term "refrigeration load" means a fluid or object that requires a reduction in energy, or removal or heat, to lower its temperature or to keep its temperature from rising.

BRIEF DESCRIPTION OF THE DRAWINGS

The sole FIGURE is a schematic representation of one preferred arrangement which may be used in the practice of this invention.

DETAILED DESCRIPTION

In general, the invention comprises the use of an unconventional refrigerant fluid, such as carbon dioxide or nitrogen, to generate refrigeration in a refrigeration cycle which operates at supercritical pressures throughout the cycle.

The invention will be described in detail with reference to the Drawing. Referring now to the FIGURE, warm temperature supercritical pressure refrigerant fluid 40 is provided to a compression device such as compressor 130. A pump may be employed in place of compressor 130 as the compression device. The critical pressure of carbon dioxide is 1066.3 pounds per square inch absolute (psia). When the refrigerant fluid comprises carbon dioxide, the pressure of the refrigerant fluid in stream 40, also termed the low side pressure, is generally within the range of from 1100 to 1500 psia. The critical pressure of nitrogen is 33.5 atmospheres. When the refrigerant fluid comprises nitrogen, the pressure of the refrigerant fluid in stream 40 is generally within the range of from 35 to 70 atmospheres.

The warm temperature supercritical pressure refrigerant fluid 40 is compressed by passage through compressor 130 to be at a higher supercritical pressure emerging therefrom as higher supercritical pressure refrigerant fluid 50. The power for compression is represented by energy input Q-130. Such input may be obtained from a direct electrical input or by shaft work derived from an internal combustion engine. When the refrigerant fluid comprises carbon dioxide, the pressure of the refrigerant fluid in stream 50 is generally within the range of from 1500 to 3000 psia. When the refrigerant fluid comprises nitrogen, the pressure of the refrigerant fluid in stream 50, also termed the high side pressure, is generally within the range of from 50 to 100 atmospheres. Typically the high side pressure of the higher supercritical pressure refrigerant fluid 50 exceeds the low side pressure of the supercritical pressure refrigerant fluid 40 by a factor within the range of from 1.5 to 3.0.

The higher supercritical pressure refrigerant fluid 50 is cooled in gas cooler 100 by indirect heat exchange with air or by another utility or heat transfer fluid. The energy extracted within gas cooler 100 is represented by energy stream Q-100. Resulting higher supercritical pressure refrigerant fluid 10 is passed from gas cooler 100 to internal heat exchanger 110 wherein it is cooled by indirect heat exchange with warming refrigerant fluid as will be more fully described below.

The cooled higher supercritical pressure refrigerant fluid is passed in stream 20 from heat exchanger 110 to an expansion device, which in the embodiment illustrated In the FIGURE is a dense phase turboexpander 120, wherein it is expanded to a low side pressure which is still higher than the critical pressure of the refrigerant fluid Energy derived from this expansion is shown as Q-120. Alternatively, the expansion device may be an isenthalpic valve. The expansion of the refrigerant fluid through the expansion device further cools the refrigerant fluid which emerges from the expansion device as cold temperature supercritical pressure refrigerant fluid in stream 30.

The critical temperature of carbon dioxide is 88° F. When the refrigerant fluid comprises carbon dioxide, the temperature of the cold temperature supercritical pressure refrigerant fluid in stream 30 is less than the critical temperature and generally is within the range of from 0 to 60° F. The critical temperature of nitrogen is −230° F. When the refrigerant fluid comprises nitrogen, the temperature of the cold temperature supercritical pressure refrigerant fluid in stream 30 is higher than the critical temperature and generally within the range of from −70 to −200° F.

The cold temperature supercritical pressure refrigerant fluid 30 is warmed to cool the higher supercritical pressure refrigerant fluid and to provide refrigeration to a refrigeration load. These two heat exchange steps could be carried out in a single heat exchanger. The embodiment of the invention illustrated in the FIGURE employs two separate heat exchangers to carry out respectively these two heat exchange steps.

Referring back to the FIGURE, cold temperature supercritical pressure refrigerant fluid 30 is divided into stream 31 and stream 32. Cold temperature supercritical pressure refrigerant fluid in stream 31 is passed to internal heat exchanger 110 wherein it is warmed to cool by indirect heat exchange the higher supercritical pressure refrigerant fluid, emerging therefrom as warm temperature supercritical pressure refrigerant fluid in stream 33.

Cold temperature supercritical pressure refrigerant fluid in stream 32 is passed to load heat exchanger 140 wherein it is warmed by indirect heat exchange with a refrigeration load thereby providing refrigeration to the refrigeration load. In the embodiment of the invention illustrated in the FIGURE, the refrigeration load is fluid in stream 60, which may be air, water or other process fluid, and which emerges from load heat exchanger 140 as refrigerated fluid in stream 70. A particularly useful application of the invention wherein the refrigerant fluid comprises carbon dioxide is to provide refrigeration for an automotive air conditioning system. In this case the fluid in streams 60 and 70 would be air.

The resulting warmed refrigerant fluid emerges from load heat exchanger 140 as warm temperature supercritical pressure refrigerant fluid in stream 34 which is combined with stream 33 to form warm temperature supercritical pressure refrigerant fluid stream 40. As discussed above, heat exchangers 110 and 140 could be combined into a single heat exchanger. In such a case stream 30 need not be divided into portions 31 and 32 and would emerge from the heat exchanger as stream 40. Alternatively the division into streams 31 and 32 shown in the FIGURE could also be carried out with both of these streams passing through the single heat exchanger and then being recombined in a manner similar to that shown in the FIGURE.

When the refrigerant fluid comprises carbon dioxide, the temperature of the warm temperature supercritical pressure refrigerant fluid in stream 40 exceeds the critical temperature and is generally within the range of from 90 to 120° F. When the refrigerant fluid comprises nitrogen, the temperature of the warm temperature supercritical pressure refrigerant fluid in stream 40 exceeds the critical temperature and is generally within the range of from——70 to 120° F. The warm temperature supercritical pressure refrigerant fluid in stream 40 is provided to compressor 130 and the refrigeration circuit is completed.

To illustrate the invention and the advantages attainable thereby, a computer simulation of the embodiment illustrated in the FIGURE was carried out wherein carbon dioxide is the refrigerant fluid, and compared to a conventional refrigeration system using a Rankine cycle and wherein the refrigerant fluid is R134a (tetrafluoroethane, $CF_3CH_2F$). In this example and comparative example the refrigeration load is air which is cooled from 100° F. to 45° F. The example is provided for illustrative purposes and is not intended to be limiting.

The results of the example and comparative example are shown in Table 1 wherein column A refers to the invention and column B refers to the conventional refrigeration system.

TABLE 1

| | A | B |
|---|---|---|
| Phases | 1 | 2 |
| Low Side Pressure (psia) | 1600 | 50 |
| High Side Pressure (psia) | 2834 | 139 |
| Relative Power Consumption | 0.66 | 1.00 |

As can be seen from the results reported in Table 1, the invention in this example operates with about one-third less power consumption than does the conventional refrigeration system.

Preferably the refrigerant fluid used in the method of this invention comprises only carbon dioxide or only nitrogen. Although the invention has been discussed in detail with reference to certain preferred embodiments, those skilled in the art will recognize that there are other embodiments of the invention within the spirit and the scope of the claims. For example other refrigerant fluids such as $C_2H_6$, $N_2O$, $B_2H_6$ and $C_2H_4$, and refrigerant fluid mixtures could be used as the refrigerant fluid.

What is claimed is:

1. A method for providing refrigeration to a refrigeration load comprising:

(A) providing warm temperature supercritical pressure refrigerant fluid and compressing the warm temperature supercritical pressure refrigerant fluid to be at a higher supercritical pressure;

(B) cooling the higher supercritical pressure refrigerant fluid and expanding the cooled higher supercritical pressure refrigerant fluid to produce cold temperature supercritical pressure refrigerant fluid; and (C) warming the cold temperature supercritical pressure refrigerant fluid by indirect heat exchange with said cooling higher supercritical pressure refrigerant fluid and by indirect heat exchange with a refrigeration load to produce said warm temperature supercritical pressure refrigerant fluid, wherein the refrigerant fluid comprises carbon dioxide and the cold temperature is less than the critical temperature of the refrigerant fluid.

2. The method of claim 1 wherein the warm temperature exceeds the critical temperature of the refrigerant fluid.

3. The method of claim 1 wherein the pressure of the supercritical pressure refrigerant fluid is within the range of from 1100 to 1500 psia and the pressure of the higher supercritical pressure refrigerant fluid is within the range of from 1500 to 3000 psia.

4. The method of claim 1 wherein the pressure of the higher supercritical pressure refrigerant fluid exceeds the pressure of the supercritical pressure refrigerant fluid by a factor within the range of from 1.5 to 3.0.

5. The method of claim 1 wherein the warming of the cold temperature supercritical pressure refrigerant fluid by indirect heat exchange with the cooling higher supercritical pressure refrigerant fluid, and the warming of the cold temperature supercritical pressure refrigerant fluid by indirect heat exchange with the refrigeration load are carried out in separate heat exchangers.

6. A method for providing refrigeration to a refrigeration load comprising:

(A) providing warm temperature supercritical pressure refrigerant fluid and compressing the warm temperature supercritical pressure refrigerant fluid to be at a higher supercritical pressure;

(B) cooling the higher supercritical pressure refrigerant fluid and expanding the cooled higher supercritical pressure refrigerant fluid to produce cold temperature supercritical pressure refrigerant fluid; and (C) warming the cold temperature supercritical pressure refrigerant fluid by indirect heat exchange with said cooling higher supercritical pressure refrigerant fluid and by indirect heat exchange with a refrigeration load to produce said warm temperature supercritical pressure refrigerant fluid, wherein the refrigerant fluid comprises nitrogen and the cold temperature exceeds the critical temperature of the refrigerant fluid.

7. The method of claim 6 wherein the warm temperature exceeds the critical temperature of the refrigerant fluid.

8. The method of claim 6 wherein the pressure of the supercritical pressure refrigerant fluid is within the range of from 35 to 70 atmospheres and the pressure of the higher supercritical pressure refrigerant fluid is within the range of from 50 to 100 atmospheres.

9. The method of claim 6 wherein the pressure of the higher supercritical pressure refrigerant fluid exceeds the pressure of the supercritical pressure refrigerant fluid by a factor within the range of from 1.5 to 3.0.

10. The method of claim 6 wherein the warming of the cold temperature supercritical pressure refrigerant fluid by indirect heat exchange with the cooling higher supercritical pressure refrigerant fluid, and the warming of the cold temperature supercritical pressure refrigerant fluid by indirect heat exchange with the refrigeration load are carried out in separate heat exchangers.

11. A method for providing refrigeration to a refrigeration load comprising:

(A) providing warm temperature supercritical pressure refrigerant fluid and compressing the warm temperature supercritical pressure refrigerant fluid to be at a higher supercritical pressure;

(B) cooling the higher supercritical pressure refrigerant fluid and expanding the cooled higher supercritical pressure refrigerant fluid to produce cold temperature supercritical pressure refrigerant fluid; and (C) warming the cold temperature supercritical pressure refrigerant fluid by indirect heat exchange with said cooling higher supercritical pressure refrigerant fluid and by indirect heat exchange with a refrigeration load to produce said warm temperature supercritical pressure refrigerant fluid, wherein the pressure of the higher supercritical pressure refrigerant fluid exceeds the pressure of the supercritical pressure refrigerant fluid by a factor within the range of from 1.5 to 3.0.

12. The method of claim 11 wherein the refrigerant fluid comprises carbon dioxide.

13. The method of claim 11 wherein the refrigerant fluid comprises nitrogen.

14. The method of claim 11 wherein the warming of the cold temperature supercritical pressure refrigerant fluid by indirect heat exchange with the cooling higher supercritical pressure refrigerant fluid, and the warming of the cold temperature supercritical pressure refrigerant fluid by indirect heat exchange with the refrigeration load are carried out in separate heat exchangers.

* * * * *